US005868059A

United States Patent [19]

Smith

[11] Patent Number: 5,868,059

[45] Date of Patent: Feb. 9, 1999

[54] ELECTROHYDRAULIC VALVE ARRANGEMENT

[75] Inventor: David P. Smith, Joliet, Ill.

[73] Assignee: Caterpillar Inc., Peoria, Ill.

[21] Appl. No.: 864,607

[22] Filed: May 28, 1997

[51] Int. Cl.[6] ..... F15B 11/08

[52] U.S. Cl. ..... 91/454; 91/459; 91/461; 137/596.16; 251/30.02

[58] Field of Search ..... 91/459, 461, 454; 137/596.16; 251/30.02, 33

[56] References Cited

U.S. PATENT DOCUMENTS

| | | | |
|---|---|---|---|
| 4,416,187 | 11/1983 | Nystrom | 91/3.61 |
| 4,750,704 | 6/1988 | Brundage | 251/30.02 |
| 4,848,721 | 7/1989 | Chudakov | 251/30.02 |
| 5,138,838 | 8/1992 | Crosser | 60/433 |
| 5,211,196 | 5/1993 | Schwelm | 91/454 X |
| 5,588,463 | 12/1996 | Kervagoret | 137/596.16 X |
| 5,597,013 | 1/1997 | Ushakov | 137/596.16 |

*Primary Examiner*—Hoang Nguyen
*Attorney, Agent, or Firm*—John W. Grant; J. W. Burrows

[57] ABSTRACT

An electrohydraulic displacement controlled valve module is disposed in a bore of a valve body for controlling fluid flow between first and second ports. A main valve element slideably disposed in the bore is biased to a closed position blocking communications between an annular groove of the valve element and the second port. An actuating chamber defined at one end of the valve element receives pressurized pilot fluid for urging the main valve element toward an open position communicating the first and second ports through the annular groove. A passage communicates the actuating chamber with a control chamber disposed at the other end of the valve element through an orifice. A poppet is disposed within the control chamber and is biased into sealing engagement with an annular valve seat of an outlet port by a feedback spring disposed between the valve element and the poppet. A proportional electromagnetic device is suitable connected to the valve body for controlling the position of the poppet relative to the valve seat to control the fluid pressure in the control chamber.

22 Claims, 2 Drawing Sheets

29
28
27
26
68
10
17
67
51
12
22
52
53
32
31
33
18
57
49
55
61
66
23
54
56
36
34
37
19
62
44
2
67
24
39
50
38
40
20
48
58
59
46
12
47
11
14
13
16
25
42
41
21
63
64
43
60
3

ELECTROHYDRAULIC VALVE ARRANGEMENT

TECHNICAL FIELD

This invention relates generally to an electrohydraulic valve arrangement and more particularly to a valve arrangement having one or more displacement controlled valve modules disposed within a common valve body.

BACKGROUND ART

A three position four-way control valve used for controlling a reversible hydraulic motor typically has a single spool for controlling pump-to-cylinder flow and cylinder-to-tank flow. One of the problems encountered with the use of a single spool is that the timing of the metering spots is designed to optimize the control of the pump-to-cylinder fluid flow. Thus, the spool is generally inadequate for metering cylinder-to-tank fluid flow in an overrunning load condition.

The problem noted above was solved somewhat by the disclosure of U.S. Pat. No. 5,138,838 which uses a pair of electrohydraulic control valves arranged so that each control valve controls fluid flow to and from only one port of a reversible hydraulic cylinder.

In a more recent development, an independent metering valve includes a pair of independently controlled electrohydraulic displacement controlled spool valves controlling pump-to-cylinder communication between an inlet port and a pair of control ports and another pair of independently controlled electrohydraulic displacement controlled spool valves for controlling cylinder-to-tank fluid flow between the control ports and an outlet. Each of the spool valves has a displacement controlled solenoid valve for controlling the position of the spool valve. The spool valves are normally biased to a closed position and are selectively actuated to provide several modes of actuation.

One of the problems encountered with those systems is that while the use of either a pair of electrohydraulic valves or four independently controlled electrohydraulic displacement controlled spool valves can provide many functions normally requiring separate valves simply by actuating one or more of the valves, the functions requiring fast response such as pressure relieving and fluid make up requires the use of special pressure sensors and increased microprocessor computing speed to operate satisfactory.

The present invention is directed to overcoming one or more of the problems as set forth above.

DISCLOSURE OF THE INVENTION

In one aspect of the present invention, an electrohydraulic valve arrangement includes a valve body having a bore and first and second ports axially spaced along and opening into the bore. An electrohydraulic displacement controlled valve module is disposed within the bore for controlling fluid flow between the first and second port. The valve module includes a main valve element slideably disposed in the bore and has an annular groove continuously communicating with the first port. A spring biases the main valve element to a closed position blocking communication between the annular groove and the second port. An actuating chamber defined at one end of the main valve element is adapted to receive pressurized pilot fluid for urging the main valve element toward an open position communicating the first and second ports through the annular groove. A passage communicates the accuating chamber with a control chamber disposed at the other end of the main valve element and includes an orifice disposed between the accuating chamber and the control chamber. An outlet port communicates with the control chamber and defines an annular valve seat. A poppet is disposed within the control chamber and is biased into sealing engagement with the valve seat by a feedback spring disposed between the valve element and the poppet. A proportional electromagnetic device suitable connected to the valve body controls the position of the poppet relative to the valve seat to control the fluid pressure in the control chamber.

BEST MODE FOR CARRYING OUT THE INVENTION

Figure 1:
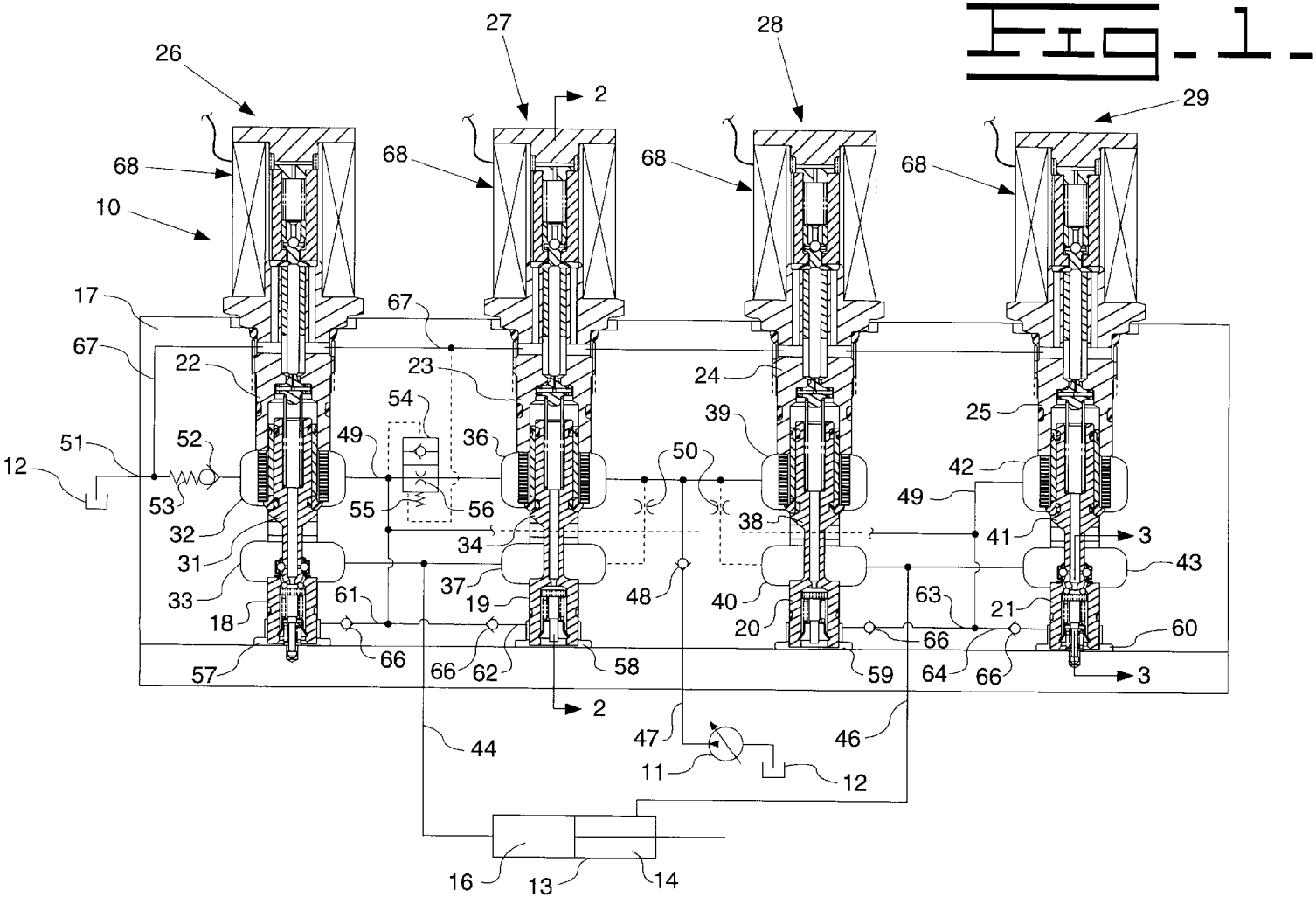
FIG. 1 is a diagrammatic and schematic illustration of an embodiment of the present invention with portions shown in cross section for illustrative convenience.

An electrohydraulic valve arrangement 10 is shown in combination with an implement pump 11, a tank 12, and a hydraulic cylinder 13 having a rod end chamber 14 and a head end chamber 16. The valve arrangement 10 includes a valve body 17 having a plurality of bores 18, 19, 20, 21 opening into a plurality of counterbores 22, 23, 24, 25, respectively. The valve arrangement also includes a plurality of electrohydraulic displacement controlled independent metering valve modules 26, 27, 28, 29 individually seated in the counterbores 22, 23, 24, 25 and suitably secured to the valve body 17.

The valve module 26 includes a cylindrical valve element 31 slideably disposed within the bore 18 for controlling communications between a pair of annuluses 32, 33, which are axially spaced along and open into the bore 18. Similarly, a valve element 34 of the valve module 27 controls communication between a pair of annuluses 36, 37, a valve element 38 of the valve module 28 controls communication between a pair of annuluses 39, 40, and a valve element 41 of the valve module 29 controls communication between a pair annuluses 42, 43. A cylinder port 44 communicates the annuluses 33, 37 with the head end chamber 16 of the hydraulic cylinder 13. Another cylinder port 46 connects the annuluses 40, 43 with rod end chamber 14 of the hydraulic cylinder. An inlet 47 communicates the pump 11 with the annuluses 36, 39 and contains a check valve 48. A passage 49 connects the annulus 42 with the annulus 32 which is connected to the tank 12 through an outlet 51. The outlet 51 contains a return flow check valve 52 disposed to generate a back pressure in the annuluses 32, 42 and the passage 49. The pressure level of the back pressure is established by a spring 53.

A pressure generating valve 54 is suitably disposed between the inlet check valve 48 and the return flow check valve 52 and is biased by a spring 55 to an open position shown communicating pressurized fluid from the pump 11 into passage 49 through an orifice 56 to maintain the predetermined back pressure upstream of the return flow check valve 52 when none of the valve modules 26–29 are actuated. The pressure generating valve 54 is shifted to a closed position isolating the passage 49 from the pump inlet 47 when pressure in the passage 49 exceeds the force exerted by the spring 55. When pressurized fluid is not being output by the pump 11, load generated pressure from either of the annuluses 37 or 40 can pass through one of a pair of orifices 50 to close the valve 54.

A plurality of actuating chambers 57, 58, 59, 60 are formed in the valve body at the lower ends of the valve elements 31, 34, 38, 41, respectively. The actuating chambers 57, 58, 59, 60 are suitably connected to the passage 49 through a plurality of inlet ports 61, 62, 63, 64 each of which contains a check valve 66 for preventing fluid flow from the actuating chamber. A common drain passage 67 connects the counterbores 22, 23, 24, 25 with the outlet 51 downstream of the check valve 52.

Figure 2:
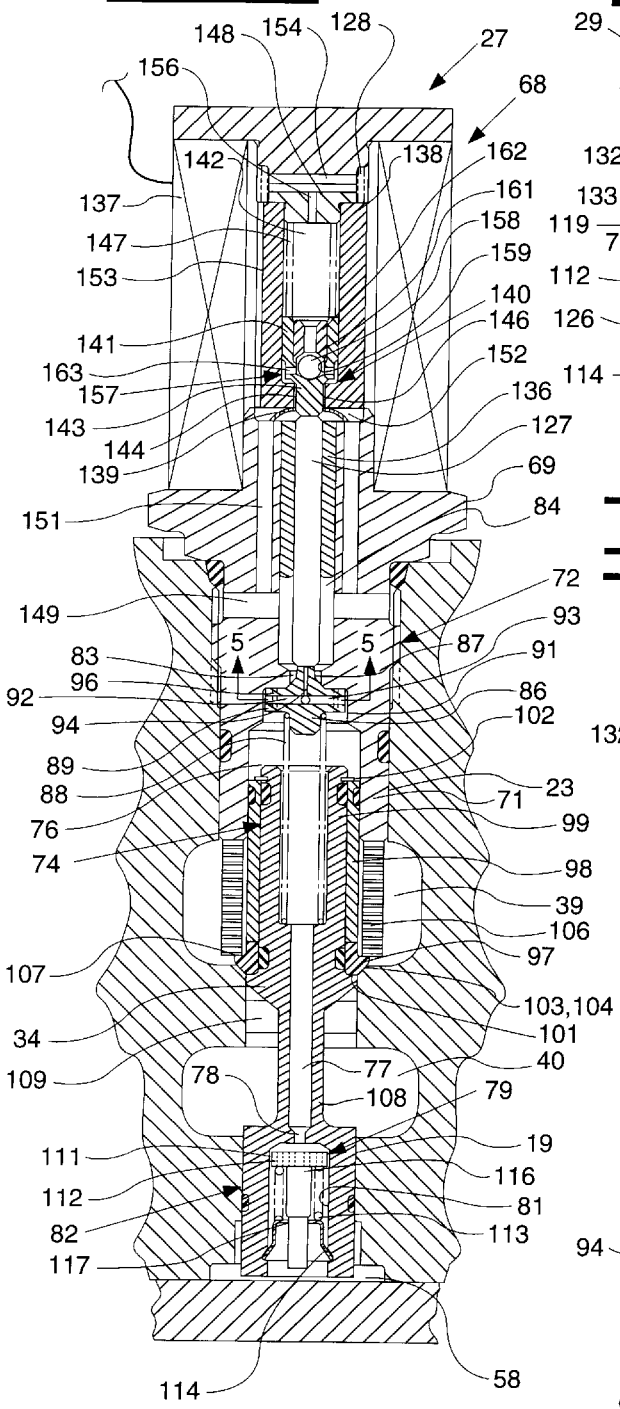
FIG. 2 is a cross-sectional view taken along line 2—2 of FIG. 1.
Figure 3:
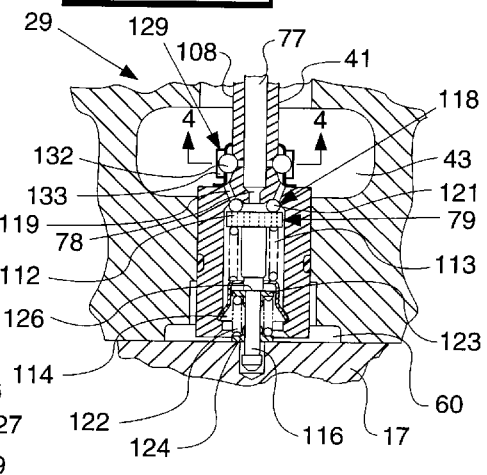
FIG. 3 is a sectional view taken along line 3—3 of FIG. 1.

While FIG. 2 is a sectional view taken through the valve module 27, it discloses the basic structural features of all 4 valve modules. FIG. 3 shows additional structural detail specifically related to the lower portion of the valve elements 31 and 41 of the valve modules 26 and 29. The structural detail specifically related to the lower portion of the valve elements 34 and 38 of the valve modules 27 and 28 are essentially identical to one another. Reference numerals used in the description of FIGS. 2 and 3 will be applied to FIG. 1 as necessary for an understanding of the operation of the valve modules.

Referring now to FIG. 2, a proportional electromagnetic device 68 includes an adapter 69 having a cylindrical portion 71 retained within the counter bore 23 by a threaded connection 72. The adapter 69 defines a portion of the bore 19 and slideably receives an upper end portion 74 of the valve element 34 to create a control chamber 76. The control chamber 76 communicates with the actuating chamber 58 through a passage 77 containing an orifice 78 and a filter 79 contained in a bore 81 in a lower end portion 82 of the valve element 34.

The adapter 69 also has an outlet 83 communicating the control chamber 76 with an exhaust flow path 84 which communicates with the drain passage 67 opening into the counter bore 23. A zero leak valve element in the form of a poppet 86 is disposed within the control chamber 76 and is biased into sealing contact with a conical valve seat 87 defined at the outlet 83 by a feedback spring 88 disposed between the valve element 34 and the poppet 86. An annular flange 89 of the poppet cooperates with a bore 91 of the adapter 69 to define an annular space 92 which is more clearly shown in FIG. 5. The annular space 92 is sized to function as a filter for filtering fluid passing from the control chamber 76 into a transverse passage 93 and a axially extending passage 94. A plurality of passages 96 extend through the annular flange 89 for communicating fluid from the control chamber 76 to the outlet port 83 when the poppet valve is unseated from the annular valve seat 87.

The valve element 34 includes an annular poppet 97 and a sleeve 98 positioned on a reduced diameter portion 99 between an annular shoulder 101 and a snap ring retainer 102. The poppet 99 has a conical valve face 103 and is biased into sealing engagement with a annular valve seat 104 by a spring 106 disposed between the adapter 69 and a spring seat 107 formed on the poppet. The annular valve seat 104 is defined at the intersection of the bore 19 and the annulus 39. In this embodiment, the spring 106 is a wave spring. The poppet 97 is preferably made from a non-metallic material such as plastic.

The valve element 34 also includes an annular groove 108 disposed between the upper end portion 74 and the lower end portion 82 and is in continuous communication with the annulus 40. A plurality of metering slots 109 open into the annular groove 108.

The filter 79 is formed by an annular space 111 defined in the other periphery of a disk 112 in the bore 81. The disk is retained in the bore by a spring 113 and a split cup shaped spring retainer 114. A stem 116 extends downward from the disk 112 through a central opening 117.

Referring to FIG. 3, the valve element 41 of the valve module 29 includes a pressure relief means 118 for communicating fluid from the annulus 43 to the actuating chamber 60 so that the valve element 41 moves to its open position when the pressure in the annulus 43 exceeds a predetermined value. More specifically, the relief means 118 includes a plurality of angled pressure relief holes 119 in the valve element 41 connecting the annulus 43 with the actuating chamber 60, a matching number of relief valve elements in the form of balls 121 biased into seating engagement with the angled holes 119 by the disk 112 and the spring 113, and a spring 122 disposed between a pair of multi-piece spring seats 123,124 slideable on the stem 116 of the filter 79. The lower spring seat 124 abuts the body 17 and the upper spring seat 123 engages an annular shoulder 126 on the stem 116.

Figure 5:
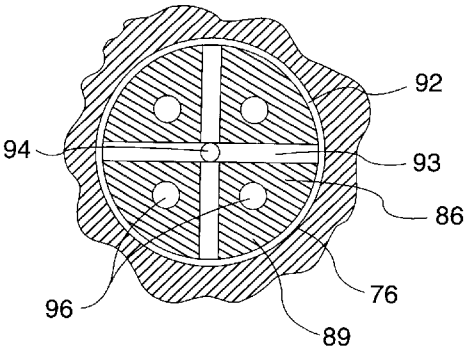
FIG. 5 is an enlarged sectional view taken along line 5—5 of FIG. 2.

The relief valve means 118 of the valve modules 26 and 29 as best seen in FIGS. 2 and 5, in this embodiment also includes the passages 92 and 94 in the poppet 86, a pin 127 normally biased into contact with the poppet indirectly by a spring 128 to block fluid flow through the passage 94 until the fluid pressure in the control chamber 76 exceeds another predetermined pressure level which is lower than the first pressure level. The second pressure level is determined by the area of the passage 94 and the force exerted on the pin by the spring 127.

Figure 4:
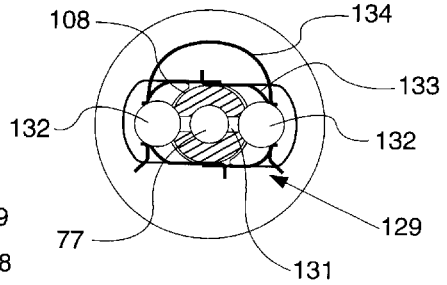
FIG. 4 is a sectional view taken along line 4—4 of FIG. 3.

Referring to FIG. 4 a fluid make-up means 129 is provided for communicating the control chamber 76 to the annulus 43 SO that the main valve element 41 moves to its open position when the fluid pressure in the annulus 43 drops below a predetermined level. The make-up means 129 includes a pair radial oil make-up holes 131 in the valve element 41 communicating the annular groove 108 with the passage 77, a pair of make-up valve elements in the form of balls 132 carried by a cage 133 and disposed for sealing engagement with the radial holes 131 and a "C" shaped spring 134 biasing the balls 132 into seating engagement with the holes 131.

Referring again to FIG. 2, the pin 127 is slideably disposed within a bearing 136 suitably fitted into the adapter 69 and also serves as a means for unseating the poppet 86 when an electrical coil 137 of the electromagnetic device 68 is energized. The coil 137 is suitably connected to the adapter 69 and encircles an armature 138 which moves downward when the coil is energized and is returned to the position shown by a curved spring washer 139 disposed between the adapter 69 and the armature 139.

A means 140 is associated with the electromagnetic device 68 and disposed to permit the release of fluid pressure in the control chamber 76 when the pressure generated force acting on the pin 127 is greater than the force generating capability of the electromagnetic device 68, but less than the another predetermined pressure level. The means 140 includes a plunger 141 slideably contained within a spring chamber 142 of the armature 138 and has a nose 143 loosely extending through a hole 144 in the armature 138 to define an annular fluid passage 146. The plunger 141 is biased downward by a spring 147 disposed in the spring chamber 142 between the plunger 141 and a plug 148 suitably connected to the armature so that the nose is normally biased into engagement with the pin 127. The force exerted by the spring 147 is greater than the force exerted by the spring 128. A plurality of radial passages 149 intersect with a plurality of longitudinal passages 151 to communicate the drain passage 67 with a space 152 between the armature 138 and the adapter 69. The space 152 communicates with the spring chamber 142 of the armature 138 through a plurality of grooves, one shown at 153 in the peripheral surface of the armature 138, a transverse slot 154 and an axial hole 156 in the plug 148 so that fluid pressure generated forces acting on the opposite ends of the armature 138 are equalized.

A check valve 157 is formed within the plunger 141 for blocking fluid flow from the annular passage 146 to the spring chamber 142 and permitting free flow between the spring chamber 142 and the annular passage 146. The check valve 157 includes a ball 158 contained within a bore 159, a conical valve seat 161 formed by a sleeve 162 pressed into the plunger 141 and a pair of radial ports 163 communicating the annular space with the bore 159 passage 146.

INDUSTRIAL APPLICABILITY

In use, the valve modules 26 and 29 control cylinder-to-tank fluid flow while the valve module 27 and 28 control pump-to-cylinder fluid flow. Conventional extension of the hydraulic cylinder 13 is achieved by simultaneous operator controlled actuation of the valve modules 27 and 29 and retraction is achieved by simultaneous operator controlled actuation of the valve modules 26 and 28. For example, actuation of the valve 27 moves the valve element 34 upward establishing fluid flow from the pump 11 to the head end chamber 16 and actuation of the valve module 29 moves the valve element 41 upward establishing fluid flow from the rod end chamber 14 to the tank 12. Similarly, actuation of the valve module 28 moves the valve element 38 upward establishing flow from the pump 11 to the rod end chamber 14 and actuation of the valve module 26 moves the valve element 31 upward establishing fluid flow from the head end chamber 16 to the tank 12. Numerous less conventional operating modes can be achieved by actuation of a single valve module 27 or actuation of various combinations of two or more valve modules. However, an understanding of the primary features of the present invention can be achieved by describing the general operation of the valve module 28 shown in FIG. 2 combined with the additional features more specifically shown in FIGS. 3 and 4.

When the electromagnetic device 68 is deenergized the poppet 86 is maintained in sealing contact with the annular valve seat 87 by the feedback spring 88. Fluid flow through the passage 94 is blocked by the pin 127 of the electromagnetic device 68. Thus fluid pressure in the chambers 76 and 28 is equalized resulting in the spring 106 exerting a net downward force to hold the valve element 34 in the closed position shown.

Fluid flow between the annuluses 39 and 40 is initiated by directing an electrical control signal to energize the coil 137 of the electromagnetic device 68. This exerts a control force against the poppet 86 through the pin 127 proportional to the strength of the electrical control signal. The control force moves the poppet downward against the bias of the feedback spring 88 for controlled fluid flow through the outlet 83 from the passage 76. The resultant fluid flow through the orifice 78 creates a pressure drop in the control chamber 76 so that pressurized fluid in the actuating chamber 58 moves the valve element 34 upward. The initial upward movement unseats the zero leak sealing between the conical valve face 103 and the annular valve seat 104 with subsequent movement establishing metered oil flow through the metering slots 109. The upward movement of the valve element 34 toward the poppet 86 compresses the feedback spring 88 which exerts a feedback force against the poppet 86 to counteract the control force exerted by the electromagnetic device 68. This movement will continue until the feedback force and the control force acting on the poppet 86 are in equilibrium. At that point, displacement of the valve element 34 is proportional to the level of the control force exerted by the electromagnetic device 68.

The valve element 34 is returned to its flow blocking position by deenergizing the coil 137 permitting the feedback spring 88 to return the poppet 86 to its sealing engagement with the annular valve seat 87 to thereby block fluid flow through the outlet port 83. The fluid pressures in the control chamber 76 and the actuating chamber 58 thus equalize so that the spring 106 biases the valve element 34 downward causing the poppet 97 to again engage the valve seat 104.

Operator controlled movement of the valve element 41 of the valve module 29 is essentially as described in conjunction with the valve module 27. However, the valve element 41 of the valve module 29 will also open automatically when the pressure in the annulus 43 exceeds the first predetermined high level to provide a relief valve function or when the fluid pressure in the annulus 43 drops below predetermined low level to provide a make-up fluid function.

More specifically, when fluid pressure in the annulus 43 exceeds the first high level, the balls 121 are unseated permitting pressurized fluid from the annulus 43 to pass through the angled holes 119 to over pressurize the actuating chamber 60. The increased pressure in the actuating chamber 60 exerts an upward pressure generated force on the valve element 41 causing an instantaneous pressure increase in the control chamber 76 to the second high level. The pin 127 and the armature 138 are thus moved upward against the bias of the spring 128 to relieve the pressure in the control chamber 76 so that the valve element 41 moves upward to establish a fluid flow path between the annuluses 43 and 42. The pressurized fluid entering the annulus 42 unseats the check valve 52 and passes directly to the tank 12.

In contrast thereto, when the fluid pressure in the annulus 43 drops below the low level, fluid pressure in the passage 77 unseats the balls 132 from the radial passages 131. This creates a pressure drop across the orifice 78, thereby reducing the pressure in the control chamber 76 so that the greater pressure in the actuating chamber 60 moves the valve element 41 upward to establish communication between the annuluses 43 and 44. Make-up fluid from the tank 12 thus passes from the annulus 42 into the annulus 43 and into the rod end chamber 14.

The pin 127 also serves to relieve pressure generated in the control chamber 76 caused by thermal expansion of oil in the chamber. When pressure in the control chamber 76 exceeds the second high level due to thermal expansion, the pin 127 is moved upwardly by pressure generated force acting on the pin 127 to allow a very small amount of oil to pass through the hole 94 in the poppet 86 to relieve the pressure in the control chamber 76. Under this condition, sufficient pressure is relieved by relieving only a few drops of oil from the control chamber 76.

For economic reasons the power of the coils 137 of the electromagnetic devices 68 is selected to unseat the poppet 86 with normal operating pressures of about 700 KPA in the control chamber 76. Thus, the electromagnetic device 68 would be unable to unseat the poppet 86 if the pressure in the control chamber 76 should become excessively high due to the above noted thermal expansion of oil in the control chamber 76 or due to leakage of load induced pressure into the control chamber 76. To alleviate this condition, the coil 137 of the respective electromagnetic device 68 is fully energized to move the armature 138 downward to compress the curved spring washer 139. Under this condition the pin 127 and the plunger 141 remain stationary so that the spring 147 is also compressed. De-energizing the coil 137 thus allows the energy in the washer 139 and the spring 147 to propel the armature 138 upward with sufficient force so that the inertia of the armature momentarily separates the plunger 141 from the pin 127. This permits the pressure in the control chamber 76 to dissipate through the hole 94 in the poppet 86 and return to the normal operating pressure. The check valve 157 permits rapid upward movement of the plunger 141 with the armature 138 but slows downward movement sufficient to permit pressure in the control chamber 76 to fully dissipate before the pin 127 again seats against the poppet 86 to block communication through the hole 94.

In view of the above, it is readily apparent that the structure of the present invention provides an improved electro-hydraulic valve module in which the pressure release and make-up functions are integrally formed as part of the main valve element. This provides fast response for pressure relieving and fluid make-up without special pressure sensors and the need for increased micro-processor computing speed.

Other aspects, objects and advantages of this invention can be obtained from a study of the drawings, the disclosure and the appended claims.

I claim:

1. An electrohydraulic valve arrangement including a valve body having a bore and first and second annular ports axially spaced along and opening into the bore, and an electrohydraulic displacement controlled valve module disposed in the bore for controlling fluid flow between the first and second annular port, the electrohydraulic valve module comprising:

a main valve element slideably disposed within the bore and having an annular groove continuously communicating with the first annular port;

a spring biasing the main valve element to a closed position blocking communication between the annular groove and the second annular port;

an actuating chamber defined at one end of the main valve element and adapted to receive pressurized pilot fluid for urging the main valve element toward an open position communicating the first and second annular ports through the annular groove;

an inlet port communicating with the actuating chamber;

a control chamber disposed at the other end of the main valve element;

passage means for communicating the actuating chamber with the control chamber and including an orifice disposed between the actuating chamber and the control chamber;

an outlet port communicating with the control chamber and defining an annular valve seat;

a poppet disposed within the control chamber;

a feedback spring disposed between the main valve element and the poppet and biasing the poppet into sealing engagement with the annular valve seat; and a proportional electromagnetic device suitably connected to the valve body for controlling the position of the poppet relative to the valve seat to control the fluid pressure in the control chamber.

2. The electrohydraulic valve module of claim 1 wherein the passage means includes a longitudinally extending passage formed in the main valve element.

3. The electrohydraulic valve module of claim 2 including relief valve means for communicating fluid from the first annular port to the actuating chamber so that the valve element moves to its open position when the pressure in the first annular port exceeds a predetermined value.

4. The electrohydraulic valve module of claim 3 wherein the relief valve means includes a check valve disposed in the inlet port, at least one relief hole communicating the first annular port with the actuating chamber, a relief valve element disposed to block fluid flow through the relief valve hole, and a relief spring biasing the relief valve element to a position blocking flow through the relief hole.

5. The electrohydraulic valve module of claim 4 wherein the relief valve hole is formed in the main valve element and the relief valve element and the relief spring are disposed in the actuating chamber.

6. The electrohydraulic valve module of claim 5 wherein the first annular port is a cylinder port adapted to be connected to a hydraulic cylinder.

7. The electrohydraulic valve module of claim 4 wherein the relief valve means includes passage means defined in the poppet communicating with the control chamber, a pin, a spring disposed to bias the pin into contact with the poppet to block fluid flow through the passage means until pressure in the control chamber exceeds another predetermined level.

8. The electrohydraulic valve module of claim 7 wherein the pin is disposed between the poppet and the electromagnetic device.

9. The electrohydraulic valve module of claim 2 including fluid make-up means for communicating the control chamber to the first annular port so that the main valve element moves to its open position when the fluid pressure in the first annular control port drops below a predetermined level.

10. The electrohydraulic valve module of claim 9 wherein said make-up means includes at least one make-up hole communicating a portion of the passage means between the orifice and the control chamber with the first annular control port, a make-up valve element disposed to block flow through the make-up hole, and a spring biasing the make-up valve element to a position blocking fluid flow through make-up hole.

11. The electrohydraulic valve module of claim 10 wherein the make-up hole is formed in the main valve element and communicates the annular groove with the longitudinally extending passage in the main valve element and the make-up valve element and the make-up spring are disposed within the annular groove.

12. The electrohydraulic valve module of claim 2 including a valve seat defined between the second port and the bore and a conical valve face formed on the main valve element and seated on the valve seat at the closed position of the main valve element.

13. The electrohydraulic valve module of claim 12 wherein the main valve element includes a reduced diameter portion, and an annular poppet disposed on the reduced diameter portion and defining the conical valve face, and an annular retainer removable fixed to the main valve element to retain the annular poppet on the reduced diameter portion.

14. The electrohydraulic valve module of claim 13 including a sleeve disposed on the reduced diameter portion between the poppet and the retainer and slideably disposed in the bore.

15. The electrohydraulic valve module of claim 14 wherein the annular poppet is made from a non-metallic seal material.

16. The electrohydraulic valve module of claim 15 wherein the reduced diameter portion includes a pair of annular grooves and including a pair of elastomeric annular seals disposed in the annular grooves.

17. The electrohydraulic valve module of claim 16 wherein one of the annular grooves is disposed adjacent the annular poppet so that the annular seal in said one annular groove seals against the annular poppet.

18. The electrohydraulic valve module of claim 17 wherein the body includes another bore, a removable adapter seated in the other bore and defining a portion of the first named bore which slideably receives the sleeve.

19. The electrohydraulic valve arrangement of claim 1 wherein the valve body has another bore and third and fourth annular ports opening into the second bore and including a second electrohydraulic valve module disposed within said second bore for controlling fluid flow between the third and fourth annular ports.

20. The electrohydraulic valve module of claim 1 including passage means defined in the poppet communicating with the control chamber, a pin, a spring disposed to bias the pin into contact with the poppet to block fluid flow through the passage means until pressure in the control chamber exceeds a predetermined level.

21. The electrohydraulic valve module of claim 20 wherein the pin is disposed between the poppet and the electromagnetic device.

22. The electrohydraulic valve module of claim 21 including means associated with the electromagnetic device and disposed to permit the release of fluid pressure in the control chamber when the pressure generated force acting on the pin is greater than the force generating capability of the electromagnetic device, but less than said predetermined pressure level.

* * * * *